US005976664A

United States Patent [19]

Lohmeyer

[11] Patent Number: 5,976,664

[45] Date of Patent: Nov. 2, 1999

[54] CURVED MOLDING, IN PARTICULAR FOR FURNITURE

[76] Inventor: Hartmut Lohmeyer, Flemingstrasse 94A, 81925 Munich, Germany

[21] Appl. No.: 08/819,170

[22] Filed: Mar. 18, 1997

[30] Foreign Application Priority Data

Mar. 19, 1996 [DE] Germany ..... 196 10 843

[51] Int. Cl.[6] ..... B24B 3/24; A47C 7/02

[52] U.S. Cl. ..... 428/136; 428/134; 428/131; 428/156; 297/452.1; 297/445.1

[58] Field of Search ..... 428/134, 136, 428/131, 156; 297/452.1, 445.1

[56] References Cited

U.S. PATENT DOCUMENTS 4,486,963 12/1984 Koike et al. ..... 34/116

5,154,485 10/1992 Fleishman ..... 297/445

*Primary Examiner*—William P. Watkins, III

*Attorney, Agent, or Firm*—Frohwitter; R. William Beard, Jr.

[57] ABSTRACT

The description is given of a molding, in particular for furniture and particularly for seating furniture, which has at least one surface with a number of curves and which consists of a multi-layered material with fibers. According to the invention, a multiplicity of slits are arranged in the at least one curved surface of the molding such that the slits can take up the change in the dimensions of the material in relation to the non-deformed state, with the result that an essentially stress-free state can be achieved without damage to the outer layers of the material in the region of the curved surface.

6 Claims, 6 Drawing Sheets

CURVED MOLDING, IN PARTICULAR FOR FURNITURE

FIELD OF THE INVENTION

The present invention relates to a molding, in particular, a curved molding used for furniture.

BACKGROUND OF THE INVENTION

Moldings for furniture, in particular for seating furniture, are frequently produced from a fibrous material such as plywood. One property of plywood is that it can be deformed only to a relatively small extent. The result of this is either that the seat or backrest moldings of a piece of seating furniture can be deformed only to a relatively small extent and thus also can be adapted only to a very limited extent to the anatomical requirements of the body of an individual or else that the corresponding moldings have to be produced from other, more easily deformable materials, which then have the disadvantage that they do not possess the structural and thermal properties which a piece of wooden furniture can afford. If a material such as plywood is deformed to too pronounced an extent, the outer layers crack, which renders the corresponding molding unusable.

Although seating-furniture moldings which have lightening holes or else elongate cutouts in the seat part or in the backrest part are known, it has been the case that these cutouts are used for decorative purposes alone. An example of such a chair model provided with decorative holes is the "Trinidat" model designed by the Dane Nana Ditzel and produced by the Fredericia chair factory. The slits provided in this case, however, are used for purely decorative purposes and thus do not allow pronounced deformation of the moldings, in particular when plywood is used.

The object of the invention is thus to provide a molding, in particular for furniture and particularly for seating furniture, which consists of a multi-layered fibrous material and by means of which it is possible to produce surfaces with pronounced curvature without outer layers being damaged on these curved surfaces after final shaping.

BRIEF SUMMARY OF THE INVENTION

According to the invention, the molding, which is used in particular for furniture and particularly for seating furniture, has at least one surface with a number of curves and consists of a multi-layered material with fibers. According to the invention, a multiplicity of slits are arranged in the at least one curved surface of the molding such that the slits can take up the change in the dimensions thereof in relation to the non-deformed state, with the result that an essentially stress-free state can be achieved without damage to the outer layers of the material in the region of the at least one curved surface. The essential advantage of the arrangement of the slits, which are not provided for decorative reasons but may also fulfill decorative purposes, is that even surfaces with relatively pronounced curvature and/or a number of curves remain free of stress as a result of the multiplicity of slits provided. During shaping, the dimensions of the slits or cutouts change, which is caused by the fact that the deformed material can be freely adapted as a result of the slits, and a stress-free state can thus be achieved. Furthermore, it is also possible for the mutual spacings between the slits or cutouts to change due to the deformation achieved. Since an essentially stress-free state of the material arranged between the slits can be achieved, damage to the outer layers of the material in the region of the curved surfaces is avoided. With a suitable arrangement of the slits, it is possible, depending on the deformation or on the radius of curvature of the deformed surfaces, for the slits, and thus also the molding itself, to change in terms of transverse dimensions, longitudinal dimensions or else diagonal dimensions.

According to a further exemplary embodiment of the invention, the slits are arranged essentially parallel to the fibers of the outer layers. The advantage of a parallel arrangement of the lightening slits to the fibers of the outer layers is that the preferred direction of the slits coincides with that of the fibers, this producing a preferred deformation direction by means of which, with account being taken of the parallel alignment of the fibers and of the thus likewise aligned slits, relatively pronounced deformation transverse to said fibers and slits can be produced without the outer layers of the material cracking.

According to yet a further preferred exemplary embodiment, the slits are arranged at an acute angle with respect to the fibers. The acute-angled arrangement of the slits with respect to the fibers of the outer layers has the advantage that, in particular, molding surfaces with a number of curves can be achieved without the situation, caused by a preferred direction, where a specific, excessively small radius of curvature results in the outer layers cracking.

According to a further preferred exemplary embodiment, the material for the molding is veneered plywood. Plywoods provided with an aesthetically pleasing, decorative outer veneer and used, for example, for convex seats have a central, circular depression in the form of a hollow. If the material is deformed in the case of such a seat panel of the prior art, the depth of this hollow is not more than 1 to 2 cm. More pronounced deformation would result in the outer veneers tearing. The invention, then, makes it possible, even in the case of plywoods provided with outer veneers, to achieve a markedly curved seat which does not even have straight sides. It is also possible, in principle, to use pronounced deformation to produce a wooden shell from a starting panel which has the multiplicity of slits according to the invention.

According to yet a further preferred exemplary embodiment, the slits are arranged so as to leave at least one non-slit border region in the moulding. A preferred arrangement of the slits is one in which the slits are of helical design, at least two helixes being arranged one inside the other and being essentially equidistant in the radial direction. It is also possible, however, for three, four or more such helixes to be arranged one inside the other. If such helical slits are arranged in a panel, then it is possible to produce the abovementioned wooden shell or a seat which has a hollow, which may also be relatively deep if required. In this case, the helical pattern of the slits begins in a region which is arranged around the lowest point of the hollow. In this manner, each cross-section of the seat panel is interrupted a number of times irrespective of whether it is taken through the center or not. These interruptions provided by the slits permit corresponding free adaptation of the material remaining between the slits, with the result that, after deformation of said material, a correspondingly stress-free state can be readily achieved, even in the case of relatively pronounced deformation.

According to yet a further preferred exemplary embodiment, the slits are arranged essentially parallel to one another. Arranging the slits parallel to one another is expedient, in particular, when there is a preferred direction for a specific deformation.

According to a further preferred exemplary embodiment, contrary to the abovedescribed exemplary embodiment, the arrangement of the slits is such that the latter run from a non-slit central region of the molding as far as the border of the latter and, in the non-deformed state, the width of the slits increases in the direction of the border of the molding. In the deformed state, it is then possible, depending on the degree of deformation of the curved surfaces, for those regions which have been slit at the border to have essentially mutually parallel slit edges again after having been deformed to a relatively pronounced extent.

The molding is preferably a seat and/or a backrest for seating furniture, this being the main application area of the molding. It is also possible, however, to use such moldings for other furniture and for other application purposes, e.g. wooden shells, parts of panelling, and the like.

According to yet a further preferred exemplary embodiment, the seat and the backrest are designed as an integral part. In the case of such an integral part, comprising a seat and backrest unit, the full effect of the advantage of the molding according to the invention is likewise achieved because the surface with pronounced curvature is provided, in particular, in the transition region between backrest and seat. Even in the case of such a surface with pronounced curvature, there is no risk of the outer layers of the veneer of the plywood cracking.

In a further preferred exemplary embodiment, in contrast to the abovementioned exemplary embodiment, the seat and the backrest are designed as separate parts. The decision to design the seat and the backrest as an integral part or to design the two parts as separate parts depends both on the respective application purpose and on the intended design of the chair.

According to yet a further preferred exemplary embodiment, it is also possible, in the non-deformed state, for the slits to run outwards in the form of rays from a non-slit central region, with the result that, at the border, the molding has non-connected webs which can be deformed with respect to the central region in such a way that it is possible to produce a shell-like seat and backrest part. In the case of a shell-like integral seat and backrest part of this type, it is clear, after the completion of deformation, that the cutouts or slits, which extend and widen outwards in the non-deformed state of the panel-like starting material, have their edges running essentially parallel to one another, these edges illustrating the fact that the material can be adapted to the respective stressing state, with the result that it is possible to achieve an essentially stress-free state of the definitively deformed part.

Further advantages, features and possible applications of the present invention are explained in detail in the following description of exemplary embodiments with reference to the drawings, in which:

DETAILED DESCRIPTION OF THE INVENTION

Figure 1:
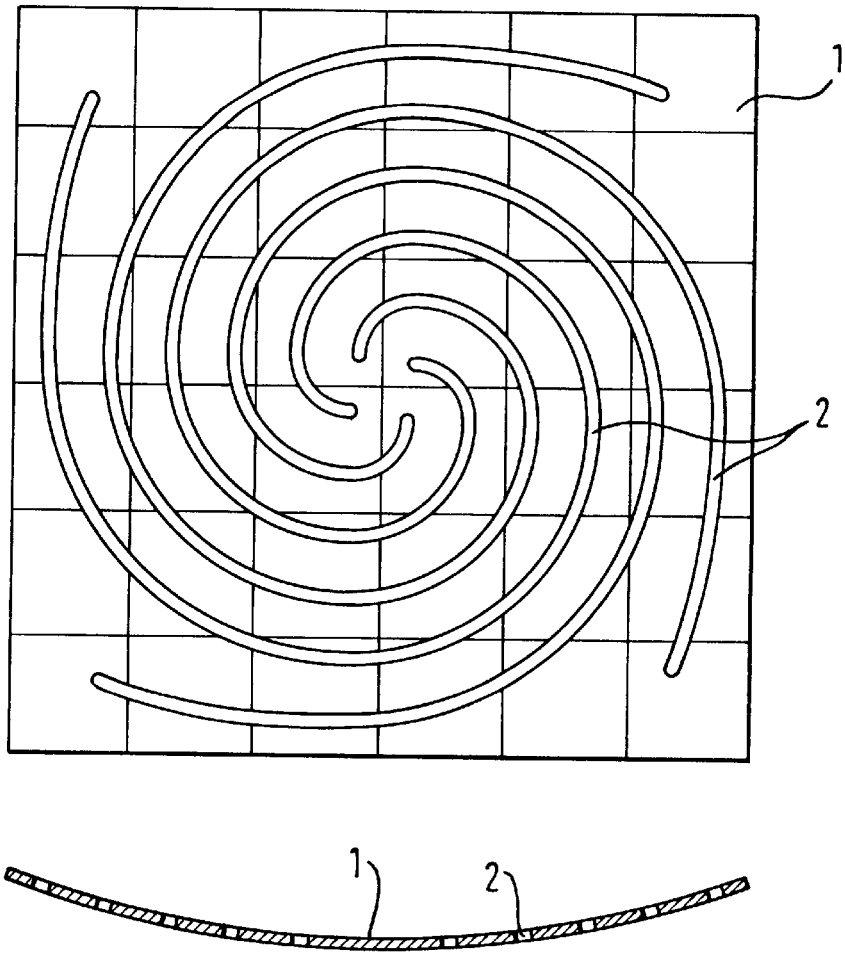
FIG. 1 shows a seat panel with four helical slits fitted one inside the other.

FIG. 1 shows an essentially square panel which serves as the seat of piece of seating furniture and in which there are provided four slits 2 which are arranged helically one inside the other, begin in that region of the panel which, after deformation, is to be the lowest part of the seat hollow, and end in the corner region of the panel in each case. A grid is depicted as a reference, but, of course, does not have to be present in the actual design. Other than in the immediate corner regions of the panel, in which regions the curvature of the helical-slit branch which ends there is greater because the degree of deformation is small or very small in these regions, the individual helical branches of the slits, by virtue of being fitted one inside the other, are at virtually equal spacings from one another, as seen in the radial direction.

Figure 2:
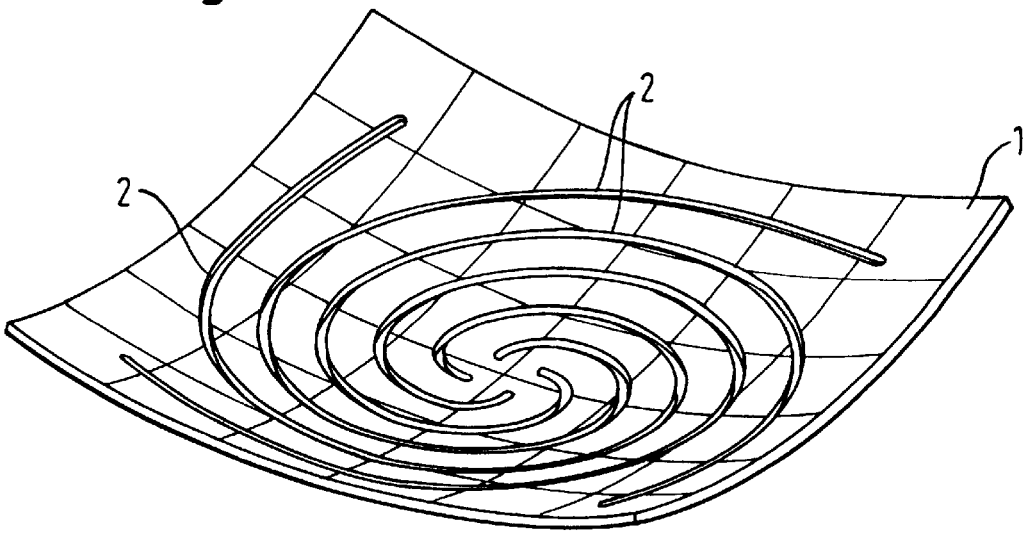
FIG. 2 shows a deformed seat panel according to FIG. 1.

Fitting these four helical slits 2 one inside the other makes it possible to obtain a seat hollow which is curved twice and to a relatively pronounced extent, as is illustrated, in principle, in FIG. 2. Such relatively pronounced deformation cannot be achieved with the conventional lightening holes in prior-art moldings, which holes serve only for decorative purposes and in the case of which the problem of arranging them in order to achieve a stress-free state after pronounced deformation is not addressed.

Figure 3:
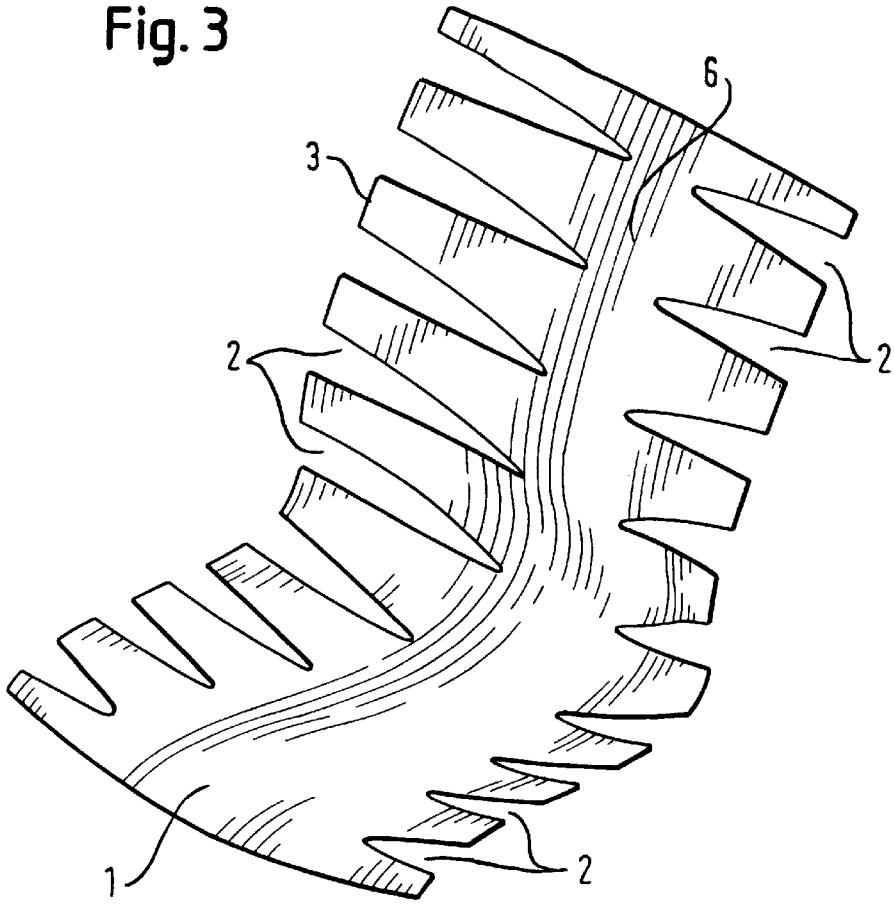
FIG. 3 shows a further exemplary embodiment, showing the arrangement of lateral slits of an integral seat and backrest part.
Figure 4:
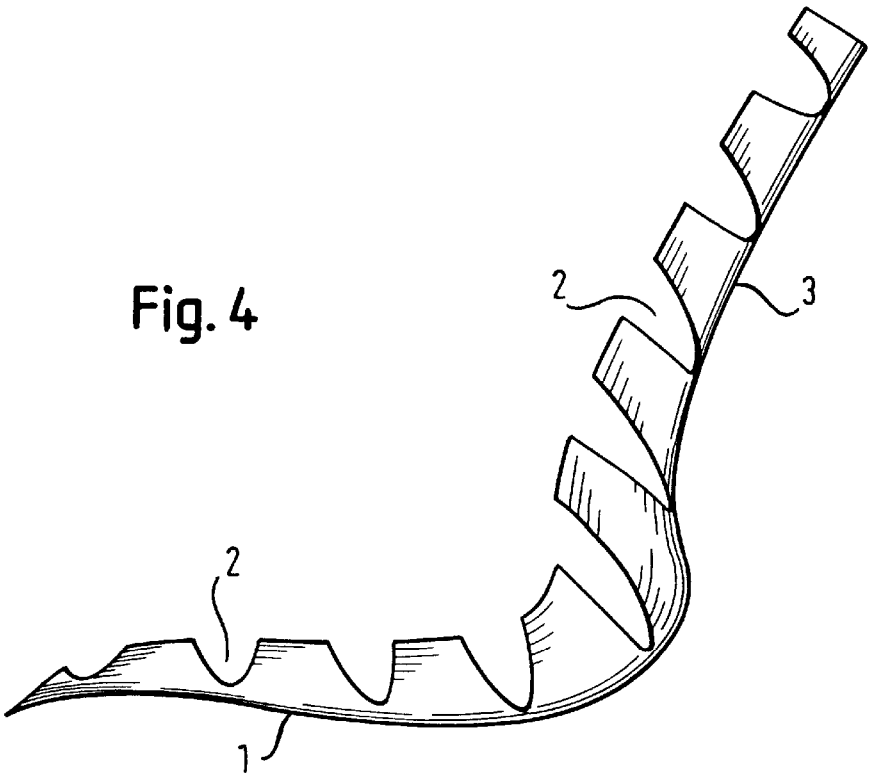
FIG. 4 shows a side view of the seat and backrest part according to FIG. 3.

The universal character of the multiplicity of slits arranged in the molding, these slits being arranged according to FIGS. 3 and 4, which illustrate a further exemplary embodiment, in the border region of the molding so as to leave a non-slit central region 6, makes it possible even to produce a complete chair framework, which is an integral part comprising a seat 1 and backrest 3. Depending on the degree of deformation of the molding, the slits 2 are made further towards the inside from the border region, with the result that the slit-free central region 6 may be of different widths in the longitudinal direction of the molding. The slits 2 according to FIGS. 3 and 4, which are made from the border of the molding as far as the slit-free central region 6, have an essentially pointed shape, which ensures that, after deformation, the edges of the slits are brought closer together, with the result that, in the case of correspondingly pronounced curvature of the surfaces 4, the delimiting edges of the slits 2 may even run parallel to one another.

The relatively large cutout as a result of wedge-shaped slits 2 permits pronounced deformation in the curved surfaces 4 without there being any risk of the outer faces or the outer veneer cracking if plywood is used. The illustration shown in FIG. 4 emphasizes those regions of the integral seat and backrest part which have surfaces 4 which are curved twice and to a particularly pronounced extent.

Using this shape of slit, it is possible, in principle, to achieve any form of oblique slope and curvature since, with corresponding arrangement of the slits 2, it is possible, despite an obliquely curved surface, to configure the molding such that, despite the curvature, each perpendicular crosspiece with the same curvature is of essentially the same length. This is particularly advantageous for using such a molding as an integral seat and backrest part. Furthermore, it is possible, using the design according to the invention, to curve the seat and backrest in the same manner and to displace the static loading onto the borders, which, due to their oblique positioning, are then also particularly strong.

Figure 5:
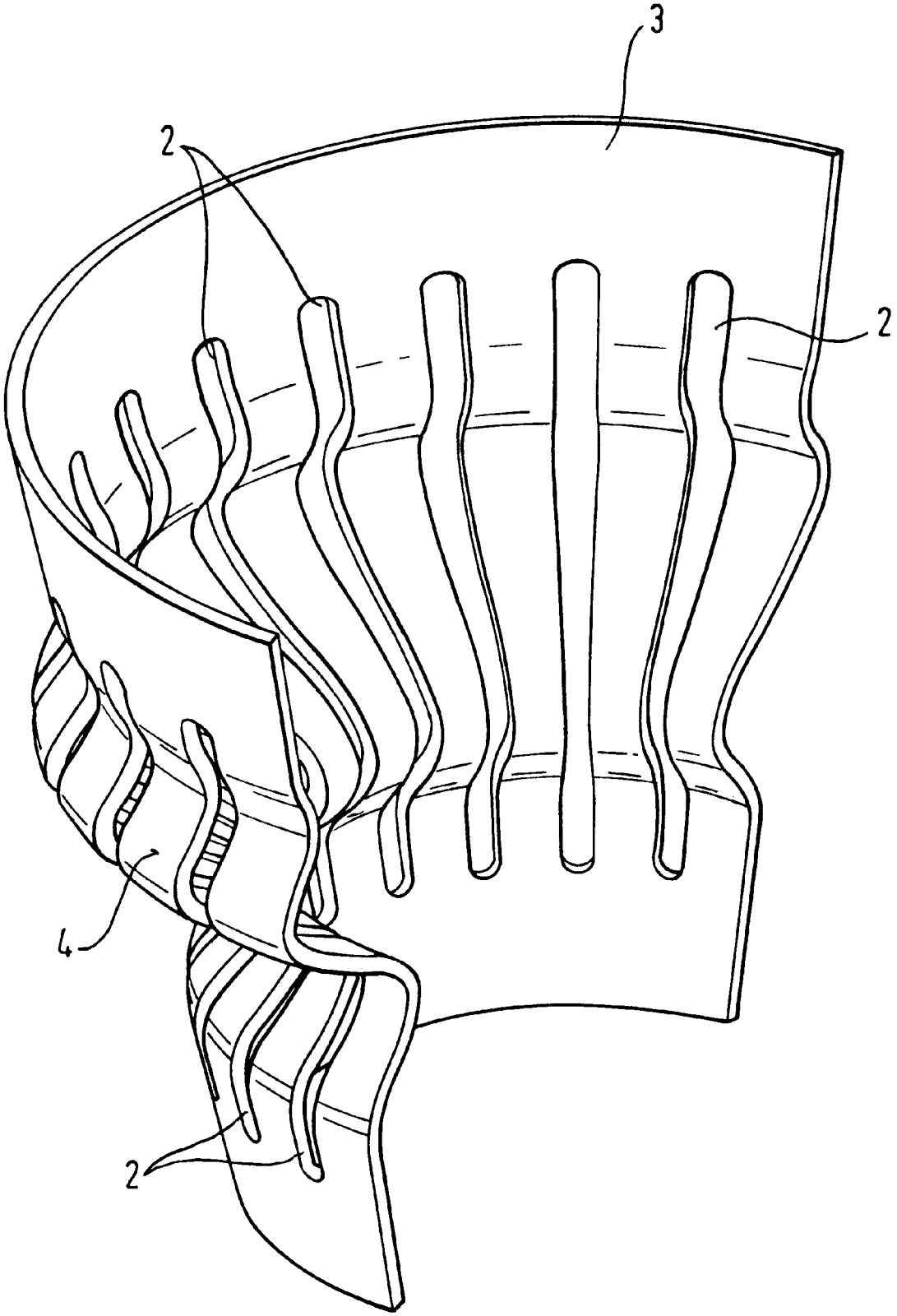
FIG. 5 shows a backrest part of a further exemplary embodiment, with regions with a number of curves in the area of the slits.

FIG. 5 illustrates a further exemplary embodiment, in which a backrest 3 has an essentially half-shell basic shape in which there are provided slits running essentially in the longitudinal direction of the half-shell element for the purpose of arranging, in the half-shell, outwardly directed and inwardly directed additional curved surfaces 4, the latter running around the circumference of the half-shell. These surfaces 4, which are curved twice and to a pronounced extent in this manner, are possible without the outer layer cracking, even if veneered plywood is used, because the relief slits are arranged such that, even in the case of pronounced deformation, a stress-free state of the material webs arranged between the slits 2 is ensured after deformation.

Figure 6:
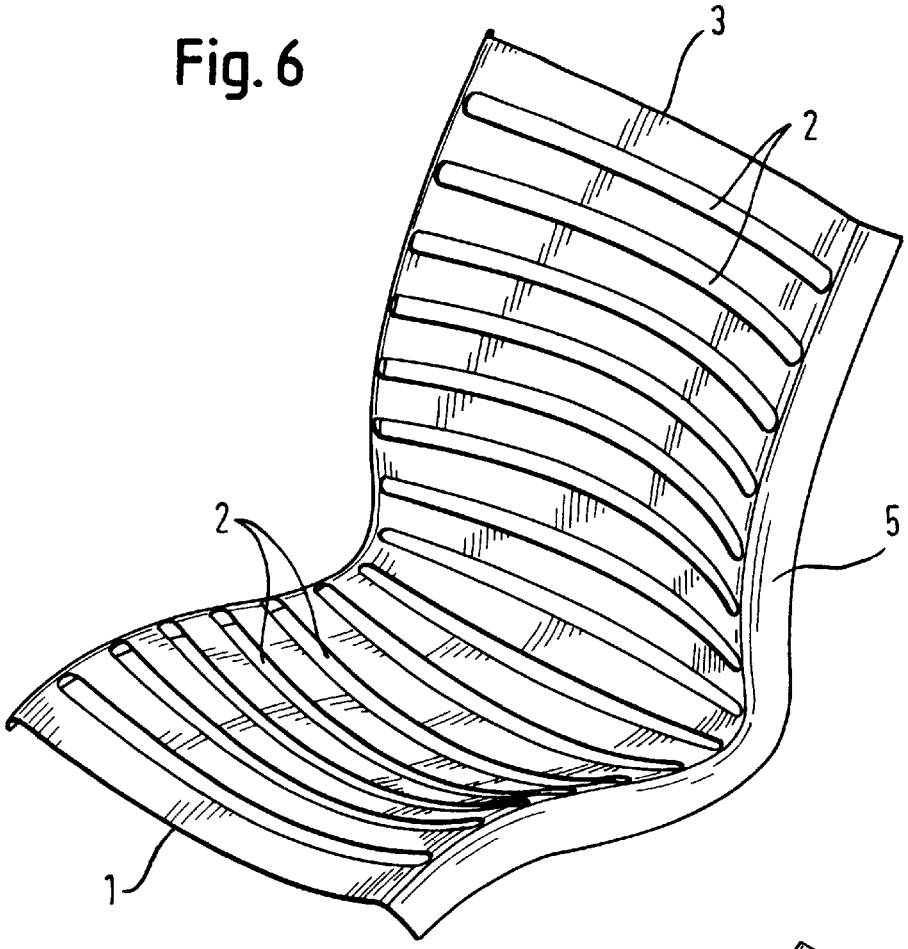
FIG. 6 shows a further exemplary embodiment of a seat and backrest part, with interior slits.
Figure 7:
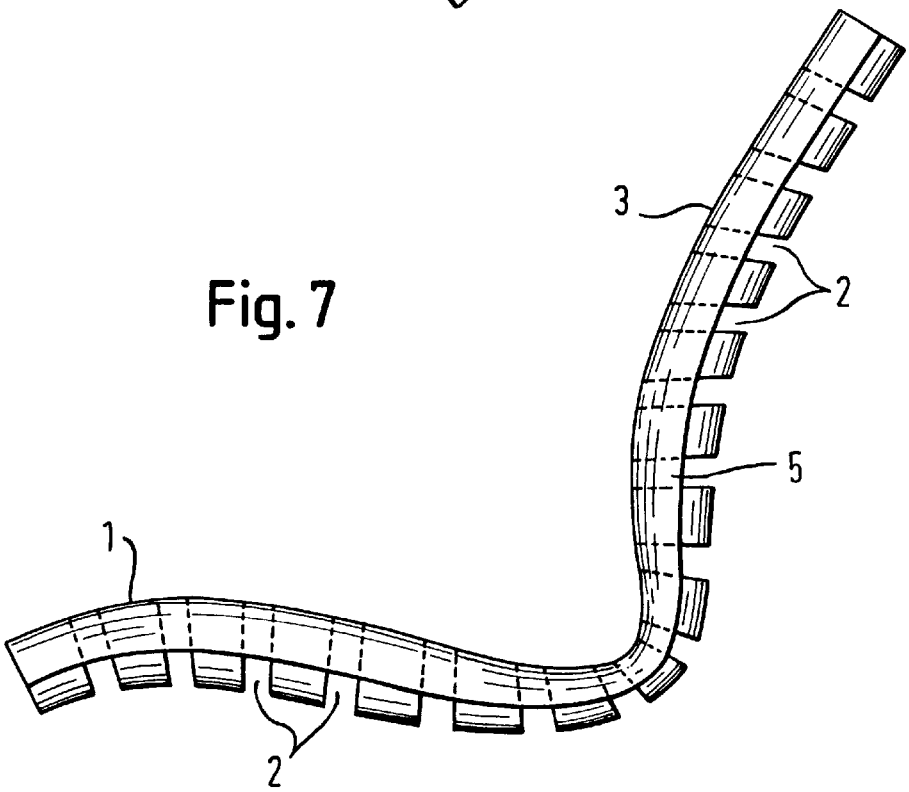
FIG. 7 shows a side view of the seat and backrest part according to FIG. 6.

FIG. 6 illustrates a further exemplary embodiment, in which the molding, as an integral seat and backrest part 1, 3, is provided with essentially parallel slits 2 which extend transversely with respect to the longitudinal direction of the molding and do not interrupt the border regions of the latter. In this case, the slits 2 extend essentially as far as that region of the seat and backrest part 1, 3 at which the non-slit border region 5 is bent. The bent section has a relatively small radius which, nevertheless, does not cause the outer-layer veneer of the plywood material to crack because the slits 2 are made to a sufficient extent as far as this bent region. Furthermore, the integral seat and backrest part 1, 3 is curved twice and to a pronounced extent in the region of transition from the area of the backrest 3 to the area of the seat 1. This twice-curved shape means that the slits, which are arranged essentially parallel to one another in the non-deformed state, no longer run parallel to one another. In addition, their delimiting edges are not necessarily aligned parallel with one another. It can be seen from this that the material can expand and compress without obstruction, depending on the degree of deformation, without it being impossible for internal stressing to be reduced. This results in an essentially stress-free state of the web material remaining between the slits 2. FIG. 7 illustrates a basic side view of the integral seat and backrest part 1, 3, which illustrates, in particular, the shape, curved twice and to a pronounced extent, in the transition region between the area of the backrest 3 and the area of the seat 1.

Figure 8:
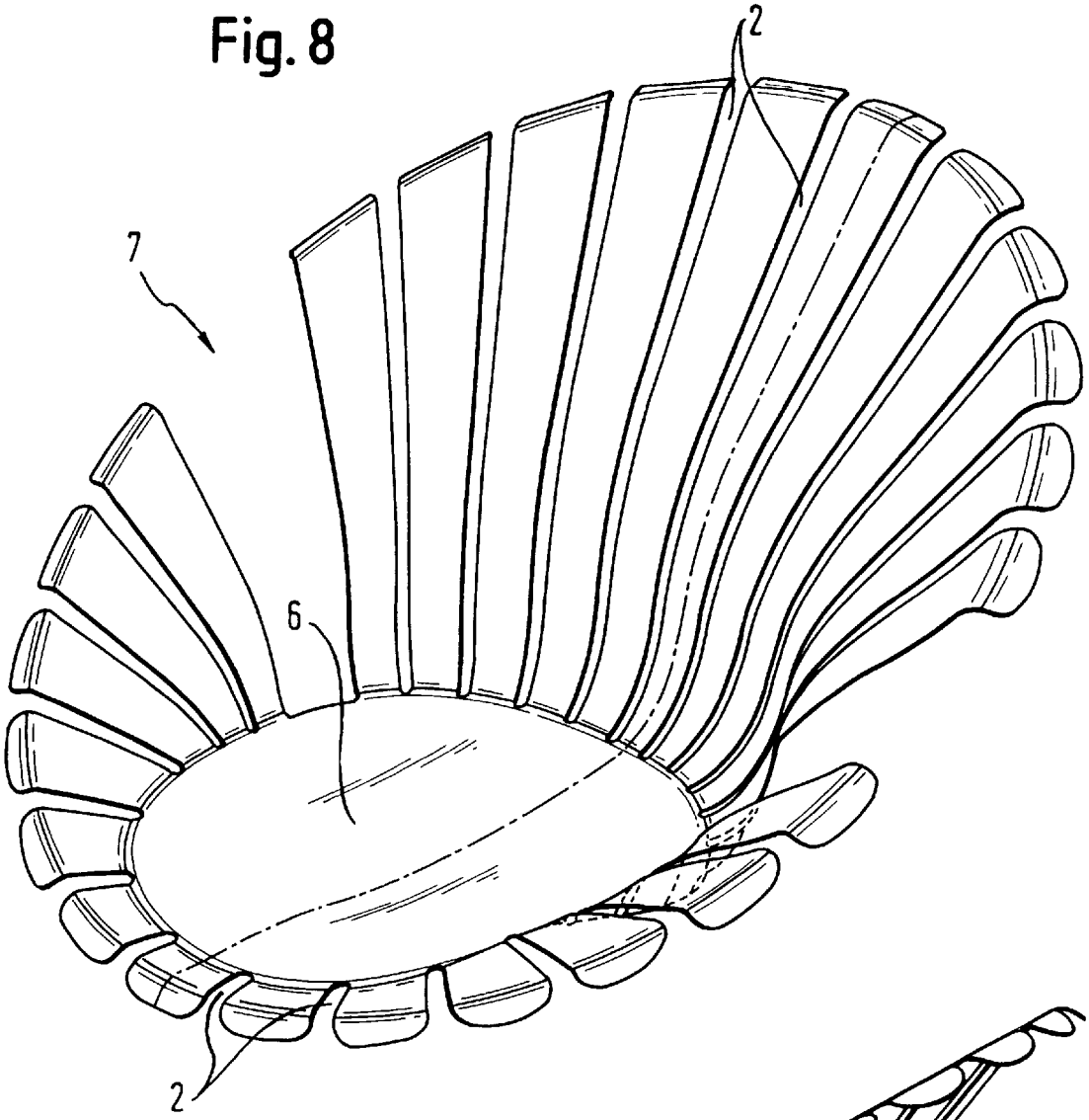
FIG. 8 shows a shell-like seat and backrest part with a non-slit central region.

FIG. 8 illustrates a further exemplary embodiment, in which an integral seat and backrest part is designed as a shell-like molding. Slits 2 extend outwards in the form of rays from a non-slit central, essentially circular region 6. In the non-deformed state, the width of the slits increases in the direction of the outer, non-connected border. Corresponding deformation into the final, shell-like shape thus results, on the one hand, in the edges of the slits being essentially parallel and, on the other hand, in it being possible for the border regions to be bent with a relatively small radius.

Figure 9:
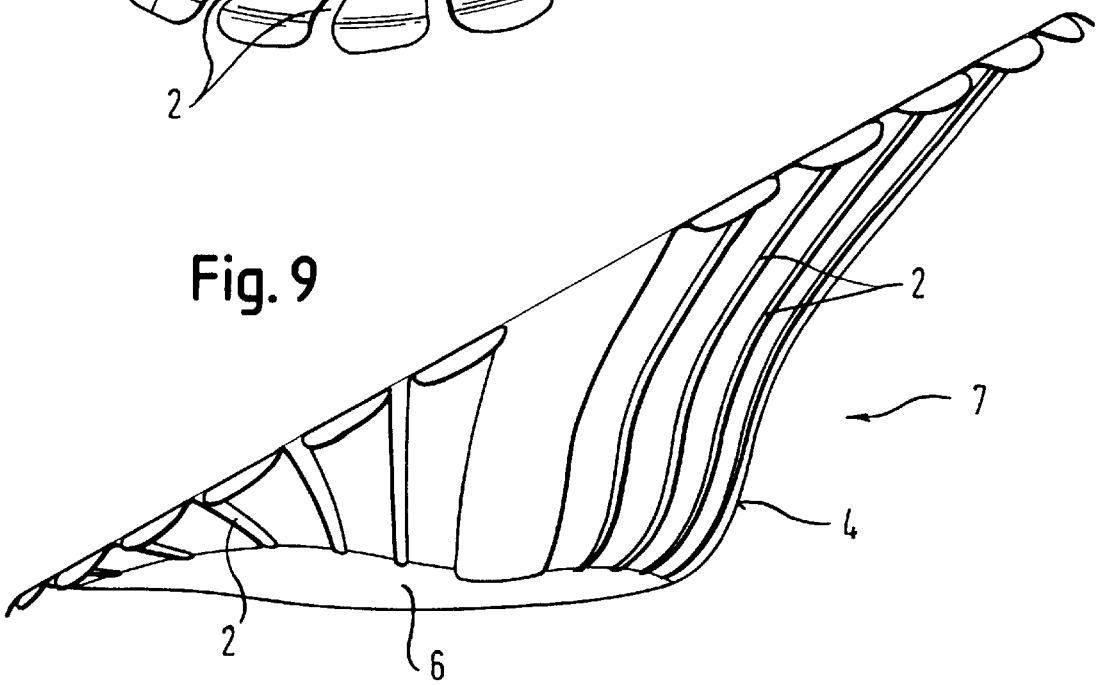
FIG. 9 shows a side view of the shell-like seat and backrest part according to FIG. 8.

FIG. 9 illustrates a side view of such a shell-like seat and backrest part 7. This clearly shows that there are numerous regions with surfaces 4 which are curved twice and to a pronounced extent. These regions can be achieved, once again, by the provision of a sufficient number of slits 2, to ensure that, in the definitively deformed state, it is possible to achieve an essentially stress-free state in particular for the outer layers of the plywood material, with the result that these layers are not subjected to cracking.

Figure 10:
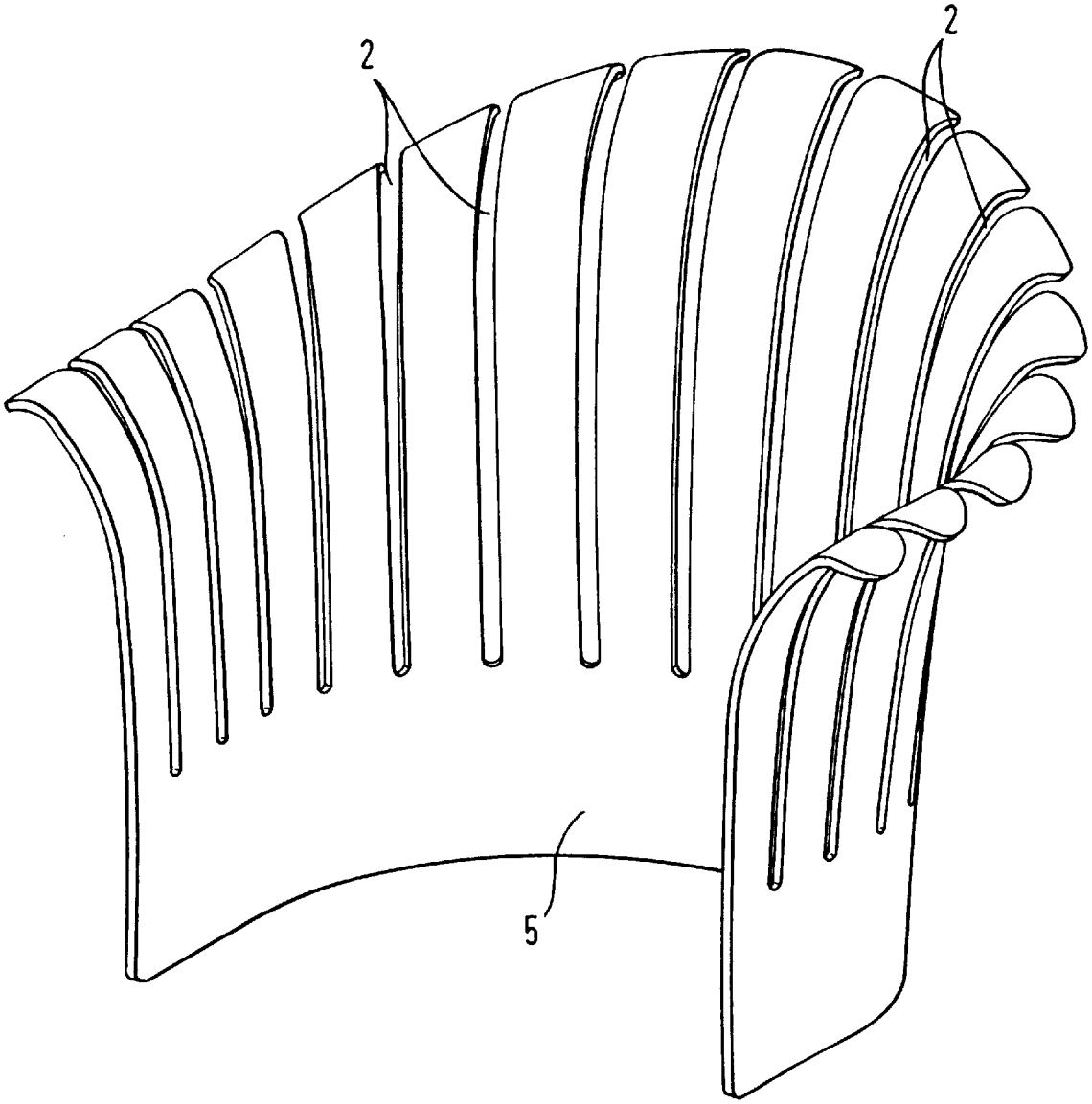
FIG. 10 shows a further exemplary embodiment, showing a backrest part which is slit on one side and has the slit border region curved outwards.

FIG. 10 illustrates a further exemplary embodiment, depicting a backrest part with one non-slit border region 5, from which essentially parallel slits extend as far as the upper border region of the backrest. The slits pass through the latter border region, thus producing material webs which are not connected to one another in this border region of the backrest. The basic shape of the backrest 3 here corresponds approximately to a half-shell shape according to FIG. 5, the difference in relation to the shape illustrated in FIG. 5, however, being that the slits are arranged so as to leave only one non-slit border region 5. That border region of the backrest which is located opposite said non-slit border region 5, and has free ends of the material webs arranged between the slits 2, makes it possible for the free ends to be bent with a relatively small radius, with the result that an all in all more attractive shape is produced and, nevertheless, stress-related cracking of the outer-layer veneer of the plywood material does not occur. Up until now, such shapes which are curved to a relatively pronounced extent have not been able to be produced from plywood by the prior-art method known for producing seats and backrests of pieces of seating furniture.

It is possible, then, for the molding according to the invention to have surfaces with pronounced curvature without the outer layers cracking, provided that the material always maintains approximately the same length in the direction of the visible fibers of the outer layers and that the slits run essentially parallel to, or at an acute angle with respect to, the fiber so as to leave a joint which can be machined, for example, by milling. It is thus possible to achieve the situation where no real stressing remains in the material even after pronounced three-dimensional deformation.

Such a molding may, then, be produced such that cutters provided in the mold cut out the slits at the same time as the pressing operation or else the individual veneers, which have to be bonded together, are provided with slits by punching, or in some other manner, prior to the pressing operation. The latter is expedient if the fibers are brought closer together by the deformation, with the result that the layers are folded one above the other without support. In contrast, the first method is expediently used when the layers are pushed apart by the deformation.

I claim:

1. A molding, in particular for furniture, which has at least one surface with a number of curves and which is produced from a multi-layered material with fibers, wherein a multiplicity of slits are arranged in the at least one curved surface of the molding such that the slits can take up the change in the dimensions of the material in relation to the non-deformed state, wherein the slits run from a non-slit central region of the molding as far as the border of the latter and, in the non-deformed state, the width of the slits increases towards the border.

2. The molding as claimed in claim 1, wherein the slits are arranged in an essentially equidistant manner.

3. The molding as claimed in claim 1, wherein the molding comprises a seat and/or a backrest for seating furniture.

4. The molding as claimed in claim 3, wherein the seat and the backrest are designed as an integral part.

5. The molding as claimed in claim 3, wherein the seat and the backrest are designed as separate parts.

6. The molding as claimed in claim 1, wherein, in the non-deformed state, the slits run outwards in the form of rays from the non-slit central region, with the result that, at the border, the molding has nonconnected webs which can be deformed with respect to the central region in such a way that it is possible to produce a shell shaped seat and backrest part.

* * * * *